US010849401B2

(12) United States Patent
Peters

(10) Patent No.: US 10,849,401 B2
(45) Date of Patent: Dec. 1, 2020

(54) HANDHELD DEVICE FOR PERFORMING AN ACTION DEPENDENT ON AN ANGULAR POSITION OF THE DEVICE

(71) Applicant: KONINKLIJKE PHILIPS N.V., Eindhoven (NL)

(72) Inventor: Johanna Katharina Peters, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 178 days.

(21) Appl. No.: 16/094,106

(22) PCT Filed: Apr. 21, 2017

(86) PCT No.: PCT/EP2017/059483

§ 371 (c)(1),
(2) Date: Oct. 16, 2018

(87) PCT Pub. No.: WO2017/182613

PCT Pub. Date: Oct. 26, 2017

(65) Prior Publication Data

US 2019/0104821 A1 Apr. 11, 2019

(30) Foreign Application Priority Data

Apr. 21, 2016 (EP) ..... 16166345

(51) Int. Cl.
*A45D 26/00* (2006.01)
*F21V 5/04* (2006.01)
(Continued)

(52) U.S. Cl.
CPC ..... *A45D 26/0028* (2013.01); *F21V 5/04* (2013.01); *F21V 23/04* (2013.01);
(Continued)

(58) Field of Classification Search
CPC ..... A45D 26/00; A45D 26/0028; A45D 2026/008; F21V 5/04; F21V 23/04; F21W 2131/20
See application file for complete search history.

(56) References Cited

U.S. PATENT DOCUMENTS 8,506,613 B2 * 8/2013 Webb ..... A61N 5/0622 607/88
9,108,327 B1 8/2015 Brooks
(Continued)

FOREIGN PATENT DOCUMENTS

DE 2117663 A1 10/1972
EP 2898790 A1 7/2015
(Continued)

OTHER PUBLICATIONS http://theflyingengineer.com/2012/10/03/a-cockpit-perspective/.
(Continued)

*Primary Examiner* — George J Ulsh

(57) ABSTRACT

The present invention relates to a handheld device (1) which is used for performing a treatment action while being moved along a treatment surface (4). The result of the treatment action is dependent on the angular position (α) in which the device (1) is being held relative to the treatment surface. An example of such a device is an epilator for removing hairs from a surface of the user's skin. The device comprises at least two light sources (5) arranged and adapted to each provide a delimited light spot (6) on the treatment surface or on an outer surface of the device when the device is in operation. The two or more light sources (5) are arranged so that the light spots (6) they provide are at least partially coincident when the device is held at an angular position relative to the treatment surface which is within a predetermined optimal range of angular positions for which the treatment action is optimal. The light spots are non-coincident when the device is held at an angular position outside said predetermined optimal range of angular positions. As a result, the user is provided with a visible indication of a correct angular position, which guides him or her towards an optimal use of the device.

11 Claims, 5 Drawing Sheets

(51) Int. Cl.

| | |
|---|---|
| ***F21V 23/04*** | (2006.01) |
| *F21Y 113/10* | (2016.01) |
| *F21W 131/20* | (2006.01) |

(52) U.S. Cl.
CPC ... *A45D 2026/008* (2013.01); *F21W 2131/20* (2013.01); *F21Y 2113/10* (2016.08)

(56) References Cited

U.S. PATENT DOCUMENTS

| | | | | |
|---|---|---|---|---|
| 10,653,224 | B2 * | 5/2020 | Steeman ..... | A45D 26/0028 |
| 2008/0222906 | A1 | 9/2008 | Austin | |
| 2012/0227554 | A1 | 9/2012 | Beech | |
| 2014/0176938 | A1 | 6/2014 | Yang | |
| 2015/0298325 | A1 | 10/2015 | Taijeron | |

FOREIGN PATENT DOCUMENTS

| | | | |
|---|---|---|---|
| WO | 2010023629 | A2 | 3/2010 |
| WO | 2013027136 | A1 | 2/2013 |
| WO | 2014115066 | A1 | 7/2014 |
| WO | 2014147532 | A1 | 9/2014 |
| WO | 2014206852 | A1 | 12/2014 |

OTHER PUBLICATIONS

Wulf, G., Chiviacowsky, S., & Drews, R. (2015). External focus and autonomy support: Two important factors in motor earning have additive benefits. Human Movement Science, 40(Sep.), 176-184. http://doi.org/10.1016/j.numov.2014.11.015.

* cited by examiner

HANDHELD DEVICE FOR PERFORMING AN ACTION DEPENDENT ON AN ANGULAR POSITION OF THE DEVICE

This application is the U.S. National Phase application under 35 U.S.C. § 371 of International Application No. PCT/EP2017/059483, filed on Apr. 21, 2017, which claims the benefit of International Application No. 16166345.5 filed on Apr. 21, 2016. These applications are hereby incorporated by reference herein.

FIELD OF THE INVENTION

The present invention relates to handheld devices adapted to be manually moved along a treatment surface while being held at an angular position relative to the treatment surface. In particular, it relates to devices for which a result of a treatment action performed by the device is dependent on said angular position.

BACKGROUND OF THE INVENTION

Handheld devices which, in operation, have to be displaced over a surface are known from various areas, such as personal care. An example of such a device is an epilator for removal of hairs from the skin of a user by mechanically grasping multiple hairs simultaneously and pulling them out. However, studies have shown that epilators are often used in the wrong way. Parameters like the speed of movement, the pressure and the angle at which the user holds and moves the epilator over the skin surface determine the efficiency of the treatment, and optimal results require optimal displacement parameters. Furthermore, non-optimal use of the device may cause injuries, skin irritations, pain or broken hairs resulting in in-growing hairs. This can cause problems to inexperienced users who have difficulty positioning the epilator at the optimal angle relative to the surface of the skin. User manuals for the device inform the user about how to use the device. However, the problem is that the user often does not know that there is room for improvement and what exactly they could improve. Furthermore, it can be difficult for the user to focus both on the surface of the skin under treatment and on the actual holding position of the device, such as at exactly which angle the device should be held and with which contact pressure the device should be pressed to the skin.

WO 2010/023629A2 discloses an epilating device comprising a detector for detecting an actual angular position of the epilating member relative to the surface of the skin. It further comprises feedback means cooperating with the detector for providing a feedback signal when the actual angular position exceeds a predetermined acceptable range of angular positions. The feedback signal may e.g. be tactile, acoustic or optical. The signal will thereby inform the user that a change in the angular position is required to obtain a better result. However, some users find it difficult to easily adjust the angular position to be within the acceptable range quickly enough to take advantage of the feedback. This is particularly the case because the result of the treatment also depends on parameters other than the angular position, such as the pressure with which the device is pressed against the surface of the skin.

DE 21 17 663 A1 discloses a shaving device comprising a light system to illuminate the skin surface to be treated. The light system comprises a light source and a light guide. Light generated by the light source is guided by the light guide towards an end portion thereof, which comprises three light exit portions. In use of the shaving device, light exiting the light guide via the light exit portions is directed towards a portion of the skin surface in front of the shaving device to illuminate the skin surface to be treated. To increase the degree of illumination of the skin surface, the optical axes of the light exit portions of the light guide mutually cross in a single point.

The inventor of the present invention has appreciated that an improved handheld device is of benefit, and has accordingly devised the present invention.

SUMMARY OF THE INVENTION

It would be advantageous to achieve a handheld device which can be more intuitively used in an optimal manner than known devices, so that the feedback can lead to improvement of the performance without needing so much attention that it causes annoyance. In particular, it would be advantageous to achieve a handheld device which increases the probability that the device is held at the optimal angular position relative to a treatment surface, in particular if the user is not aware of the optimal angular position. Furthermore, the use of the device should preferably not cause annoyance to the experienced user already having some ideas of how to optimize the result. It would also be desirable to obtain a device which can be operated without a need for additional sensors. Furthermore, it would be advantageous to make some embodiments of the invention customizable to the preferences of each individual user. In general, the invention preferably seeks to mitigate, alleviate or eliminate one or more of the above-mentioned disadvantages singly or in any combination. In particular, it may be seen as an object of the present invention to provide a device that solves the above mentioned problems, or other problems, of the prior art.

To better address one or more of these concerns, in an aspect of the invention a handheld device is presented that is adapted to be moved along a treatment surface while being held at an angular position relative to the treatment surface, the device comprising:

- a housing, and
- an operating member arranged at least partially within the housing, the operating member being adapted to perform a treatment action on or close to the treatment surface when the device is in operation, wherein a result of the treatment action is dependent on the angular position relative to the treatment surface, and wherein the device further comprises two or more light sources arranged and adapted to each provide, during operation of the device, a delimited light spot on the treatment surface or on an outer surface of the device, said outer surface having a predefined angular position relative to the treatment surface when the device is in operation, and wherein the two or more light sources are arranged so that the light spots provided by the two or more light sources are:

- at least partially coincident when the device is held at an angular position relative to the treatment surface which is within a predetermined optimal range of angular positions for which the treatment action of the operating member is optimal, and
- non-coincident when the device is held at an angular position relative to the treatment surface which is outside said predetermined optimal range of angular positions.

By "treatment surface" is preferably meant the surface along which the device is moved to enable some kind of treatment to be performed. It does not necessarily mean that the surface itself is treated. Furthermore, it does not necessarily mean that the treatment is directly or indirectly related to the surface.

By "angular position" is preferably meant a measure of an angle enclosed by a reference axis, typically a longitudinal axis of the device, and a reference plane extending parallel to the treatment surface at the actual position of the device on the treatment surface. For the skin of a user, the surface of the skin will only locally be considerable as being plane. In embodiments wherein the housing of the device has a main extension in a longitudinal direction, said longitudinal axis extends parallel to said longitudinal direction.

When the handheld device is an epilating device as will be described below, the result of the treatment may e.g. have one or more of the following characteristics: epilation efficiency, epilation quality, percentage of remaining hairs after a single passage of the epilating member over the skin, average length of extracted hairs, uniformness of the length of the hairs after extraction from the skin, noise, collection of extracted hairs inside the epilating device, wearing-down of the epilating member, and skin irritation. A desired treatment result and the corresponding optimal range of angular positions of the device relative to the treatment surface may have to be a compromise in case not all relevant parameters would require the same optimal angular position.

The delimited light spots are preferably obtained by using light sources which generate substantially non-diverging beams of light. Examples of such light sources will be given below.

The device may further comprise drive means for providing power to enable the treatment action of the operating member, typically a motor. Such drive means may e.g. be powered by a battery, such as a re-chargeable battery. The device may alternatively or in combination therewith be provided with an electric cable for connection to the mains electricity supply.

When deciding, during the design process of the device, where the one or more light spots are to be provided, it has to be taken into account that the light spots should preferably be easily visible by the user within the typical angle of the user's view during normal operation of the device, i.e. without any parts of the device or the user himself or herself blocking the angle of view.

An advantage of the device according to the present invention over known devices using sensors to provide a feedback signal to the user is that it works based on optical geometry related to the light beams and the resulting light spots. This means that no additional sensors are needed for the functioning of the device. Furthermore, the user of a device that is to be manually moved across a treatment surface already uses vision to perform this task. The present invention is also related to providing optimal vision properties, so that the information provided by the shape and/or position of the light spots is easily caught and interpreted by the user without much additional attention and care being needed. Furthermore, it will still be possible for the user to hold the device at another angular position than the optimal angular position, if so desired.

In such a presently preferred embodiment, there may be two light sources which are arranged symmetrically offset from a central axis of the device and pointing towards a plane containing the central axis, so that the light beams intersect to form coincident light spots when the device is held at an angular position as intended for the optimal use. This will be illustrated in the figures.

The efficiency of the operating member and the quality of the result of the treatment action may be influenced by parameters other than the angular position, such as the pressure with which the user holds the device against the skin surface and the speed with which the device is moved. Providing the user with easy guidance in relation to the optimal angular position enables the user to optimally control the positioning of the device in 3D. For at least some applications of the device, the invention also provides a better user experience, because the focus of the user is on the light spots and not so much on e.g. possible pain related to the treatment action. When these light spots are close to the working area of the device, such as the skin being treated, the easy guidance allows the user to more carefully focus on the other parameters influencing the result. This has proven to provide a higher satisfaction as regards both the final result and the process itself. A typical application for which this may apply is epilators for hair removal from the skin. This will be explained in further detail below and in relation to the figures. For devices for use on the skin of a human, such as an epilator, a pressure applied on the skin with a component perpendicular to the skin will result in a depression of the skin. This depression of the skin will also influence the shape and/or the position of the light spots, although to a relatively small extent.

For some applications of a device according to the invention, the optimal pressure with which the device is to be pressed against the skin may be zero. In such applications the device slides along the treatment surface possibly without touching the treatment surface. Such a device may e.g. use an airflow to keep a small distance with respect to the treatment surface.

In general, a device according to the invention provides an optimal treatment result when the device is held at an angular position relative to the treatment surface which is within a predetermined optimal range of angular positions. Said optimal range of angular positions may be relatively small. In an embodiment, the light spots will be fully coincident when the device is held in a most optimal angular position, for example an angular position centrally between the two outermost positions of the optimal range, and the light spots will be partially coincident when the device is held in another angular position within the optimal range. Thus, a device according to the invention may operate satisfactorily over a range of angular positions, i.e. even when the light spots are not fully coincident, e.g. partially coincident. For such devices, the distance between the light spots or the amount of overlap of the light spots can be used as guidance towards an even better performance obtained by decreasing the distance between the light spots or increasing the amount of overlap of the light spots. Hereby, the visible reference to moving light spots has proven to provide an intuitive guidance.

The extent of the predetermined optimal range of angular positions for which the treatment action of the operating member is optimal will depend on the type of operating member. In general, for most types of operating members like epilating, shaving or grooming members said extent of the predetermined optimal range of angular positions will be smaller than 60°. Accordingly, for most types of operating members, the delimited light spots provided by the two or more light sources on the treatment surface during operation of the device, i.e. with the operating member in its normal, usual operating position, will at least partially coincide only when the device is held at an angular position relative to the treatment surface which is within a predetermined range of mostly 60°. It will be clear for the skilled person that said extent of the predetermined optimal range of angular positions might be smaller than 60°, such as for example smaller than 45° or even smaller than 30°. It will further be clear for the skilled person that the size of the delimited light spots provided by the two or more light sources on the treatment surface will depend on said extent of the predetermined optimal range of angular positions. In general, to achieve coincident or partially coincident light spots only when the device is held at an angular position relative to the treatment surface which is within a relatively small predetermined optimal range of angular positions, the size of the delimited light spots provided by the light sources might need to be relatively small. In practice, for example, the delimited light spots might have a maximum dimension which is smaller than 50% of a maximum dimension of a contact surface via which the operating member is in contact with the skin surface, i.e. in its normal, usual operating position and with an angular position relative to the treatment surface within the predetermined optimal range of angular positions. For relatively small extents of the predetermined optimal range of angular positions, the delimited light spots might have a relatively small maximum dimension, which is for example smaller than 25% or even smaller than 15% of the maximum dimension of said contact surface.

The two or more light sources may comprise a laser, LED, OLED, incandescent lamp or a combination thereof. An LED is a light emitting diode, and an OLED is an organic light emitting diode in which the emissive electroluminescent layer is a film of an organic compound that emits light in response to an electric current. Alternatively or in combination therewith, the device may further comprise one or more light guiding components, such as lenses or light guides, arranged in relation to the two or more light sources to provide a delimitation of the light spots. The aim is to provide light sources, possibly provided with lenses, which each generate a non-diverging, i.e. parallel, light beam and thereby are adapted to provide clearly delimited light spots on the treatment surface. In studies performed in relation to the development of epilators made in accordance with the present invention, red lasers operating at 3-5 Volts were tested and found to provide easily visible light spots without annoying the user.

The two or more light sources may be arranged such that the light spots are provided in a region proximate to a treatment area wherein the treatment action of the operating member is performed. Hereby it is easy for the user to obtain the intended information about compliance with the optimal angular position and to simultaneously view the area where the treatment action takes place. If desired, a further light source may be provided to illuminate said area. This may make it easier to use the device in circumstances of reduced light intensity, such as in a shower.

In an embodiment of the invention, different colours of light of the light sources are selectable. Possible examples of colours are red, yellow, white, green or blue. In principle, any colour will be possible, including combinations of two or more colours. A change of the light colour for a given device may e.g. be made possible by exchanging the light sources or by exchanging coloured filters in front of the light sources. Studies conducted in relation to the present invention in the embodiment of epilators have revealed that choices which are actually not relevant for the task itself may influence the task performed. In particular, the colour of light may be chosen to depend on the colour of the skin of the user. In some embodiments, there may also be one or more light sources providing non-visible light, such as infrared light or UV-light.

A device as described above may further comprise at least one on-off switch for switching on and off the two or more light sources. This could e.g. be relevant for users who find it easy enough to use the device without the guidance provided by the light spots and/or who find the light spots annoying under certain circumstances. The device may further comprise at least one size switch for changing a size and/or a shape of the light spots. This could e.g. be enabled by providing the device with a movable member having optical holes of different sizes which can be moved in front of the light sources. For both of the two last-mentioned embodiments, a result might be an increase in the user's feeling of autonomy leading to a higher satisfaction with the device.

In some embodiments of the invention, the device may comprise three or more light sources. The use of three or more light sources provides a higher precision for devices having more degrees of freedom with respect to the possible movement of the device. It might e.g. be relevant for some medical devices. The positioning of the three or more light sources will be determined as part of the design process by taking into account the overall geometry of the housing as well as the possible and the intended movement of the device during use.

A device according to the invention may further comprise a contact member arranged pivotally relative to the housing, said contact member comprising a contact surface adapted to extend parallel to the treatment surface during operation of the device for facilitating a desired movement of the device along the treatment surface. Alternatively, the housing may slide along the surface. In such an embodiment, the two or more light sources may be arranged and adapted to provide the light spots on an outer surface of said contact member instead of on the treatment surface. This will provide a similar indication to the user about the optimal angular position as generally contemplated by the invention because, as a result of the pivotal arrangement of the contact member relative to the housing, said outer surface of the contact member will have a predefined angular position relative to the treatment surface when the device is in operation. In general, the invention also covers embodiments wherein the light spots are provided on another outer surface of the device which has a predefined, in particular a constant, angular position relative to the treatment surface during operation of the device.

A device according to the invention may be embodied as an epilating device for epilating hair from a surface of the skin, wherein the operating member is an epilating member. Here and in the following "epilate" could also be referred to as "depilate". An epilator is an electrical device used to remove hairs from the skin by mechanically grasping hairs and pulling them out of the skin. For an optimum performance of such an epilator, the device should be held at an optimum angular position or, more generally, at an angular position within an optimal range of angular positions relative to the surface of the skin being treated. In such an embodiment, wherein the device is an epilating device, also called an epilator, the longitudinal axis of the housing of the epilating device is rotatable relative to the skin surface only about an axis which is oriented parallel to the surface of the skin and perpendicular to a moving direction of the epilating device, in particular when the epilating device has an epilating member generally in the form of a cylinder having a cylindrical skin contacting circumference.

The epilating member of an epilator typically incorporates a series of metal and/or ceramic plates mounted in a plastic housing. The ends of the plates may be exposed at one or both sides of the housing. As the epilating member rotates, the tips of the plates move into mutual contact and apart one or more times per revolution. This creates a tweezing effect, whereby any hair clamped between the plates, when they are closed, is pulled out of the skin as the plates rotate away from the skin, and subsequently released as the plates move apart. This causes a continuous cycle of gripping, pulling, extracting and discarding hairs as the epilator is moved across the surface of the skin.

In an epilating device according to the invention, the epilating member may comprise clamping members which are rotatable relative to the housing about a rotational axis, wherein the predetermined optimal range of angular positions is associated with an angular effective operating zone of the clamping members relative to the rotational axis. The clamping members may comprise pairs of clamping elements which are adapted to open and close to clamp hairs and extract the hairs from the skin during rotation of the clamping members about the rotational axis, wherein the angular positions of the clamping members relative to the rotational axis, in which the clamping members open and close, are predefined. The clamping members are typically but not necessarily disc-shaped. The angular effective operating zone is typically the stationary, non-rotating zone (relative to the housing) wherein adjacent clamping members cooperate in a tweezer-like manner for gripping and extracting hairs from the skin.

Other devices for which an optimum angular position of the device relative to the skin surface is required are also covered by the present invention. Examples of such devices are personal care devices like Intense Pulsed Light (IPL) devices, shaving and grooming devices, facial brushes, and skin massaging devices.

In general, the various aspects of the invention may be combined and coupled in any way possible within the scope of the invention. These and other aspects, features and/or advantages of the invention will be apparent from and elucidated with reference to the embodiments described hereinafter.

BRIEF DESCRIPTION OF THE DRAWINGS

Embodiments of the invention will be described, by way of example only, with reference to the drawings, in which FIG. 1 schematically shows a side view of a handheld device according to the present invention.

DETAILED DESCRIPTION OF THE EMBODIMENTS

Figure 1:
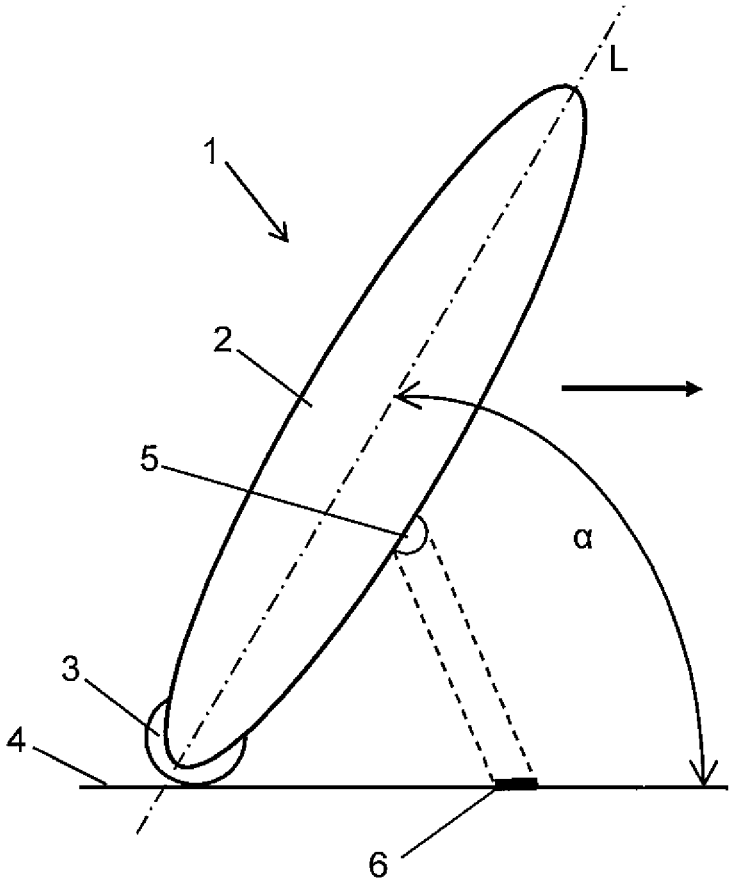

A handheld device 1 according to the invention is schematically shown in FIG. 1. The device 1 comprises a housing 2 and an operating member 3 arranged at least partially within the housing 2. The device 1 is adapted to be moved along a treatment surface 4 during use while being held at an angular position α relative to the treatment surface. In the embodiment shown in FIG. 1, the angular position α is defined in relation to a longitudinal axis L of the housing 2. In this embodiment the longitudinal axis L extends parallel to a main direction in which the longitudinal housing 2 extends. The direction of movement of the device 1 over the treatment surface 4 is illustrated with an arrow. The operating member 3 is adapted to perform a treatment action on or close to the treatment surface 4 when the device 1 is in operation. In the following, the invention will be explained with reference to a device embodied as an epilator. This is an example of a handheld device wherein a result of the treatment action is dependent on the angular position α relative to the treatment surface. In this case, the treatment action is the removal of hairs from the skin.

As shown in FIG. 1, the device 1 comprises two or more light sources 5 arranged and adapted to each provide a delimited light spot 6 on the treatment surface 4, i.e. the surface of the skin when the device is an epilator. As FIG. 1 is a side view, only one of the light sources 5 is visible. For other kinds of devices according to the invention, the two or more light spots 6 may be provided on an outer surface of the device 1 when the device is in operation, wherein the outer surface has a predefined angular position relative to the treatment surface 4 when the device 1 is in operation. Such an outer surface may e.g. be on a contact member as will be described below. As will be clearer from the following figures, the shape and/or position of the two or more light spots 6 provide information about a correspondence between an actual angular position at which the device is actually held relative to the treatment surface 4 and a predetermined optimal angular position or an optimal range of angular positions for which the treatment action of the operating member 3 is optimal. The definition of the angular position depends on how the longitudinal axis L is defined. However, as both the definition of the angular position α and the corresponding arrangement of the light sources 5 are determined during the design process of the device, this will not influence the scope of protection. The shape of the housing 2 of the device 1 shown in FIG. 1 and in the following schematical figures is not intended to illustrate the real shape of the device. The main focus in the figures is to illustrate the working principle of the invention.

Figure 2:
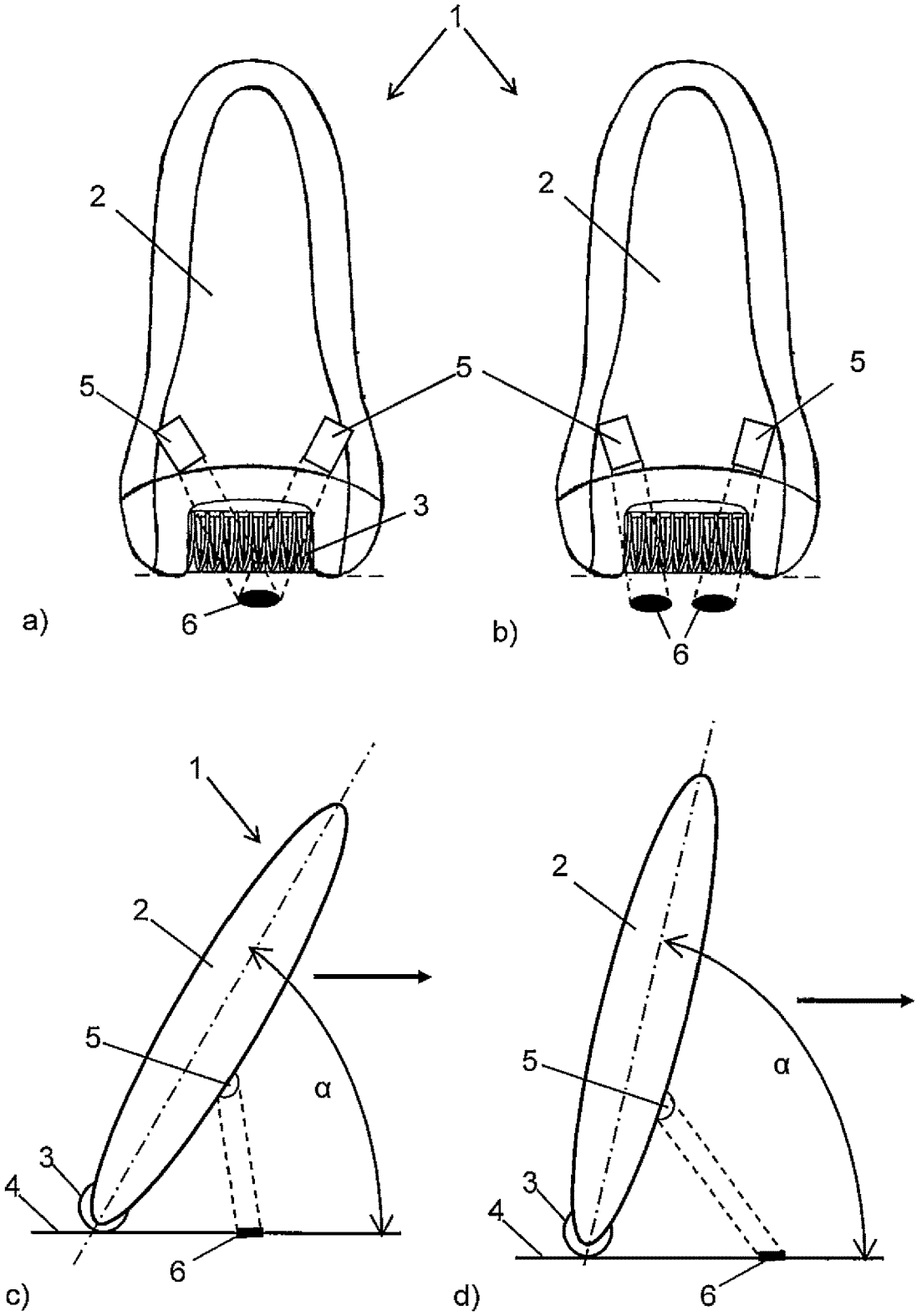
FIG. 2 schematically shows an embodiment having two light sources.

FIG. 2 schematically shows front and side views of a device 1 with two light sources 5. In FIGS. 2.*a* and 2.*b*, the device 1 is seen in a direction opposite to the direction of movement. In principle, the light sources could also be arranged so as to point away from the direction of movement, but then the user would have to pay attention to two different areas. However, this might still be relevant for devices having a design such that it is difficult to see the light spots if they are provided ahead of the device with respect to the direction of movement. The device in FIG. 2 comprises two light sources 5 arranged such that the light spots 6 are:

- at least partially coincident when the device 1 is held at an angular position α which is within a predetermined optimal range of angular positions for which the treatment action of the operating member 3 is optimal. In FIG. 2.*a*, the two light spots 6 are shown as being fully coincident;
- non-coincident when the device 1 is held at an angular position α which is outside said predetermined optimal range of angular positions. This is shown in FIG. 2.*b*. As illustrated, too small or too large angular positions of the device in relation to the treatment surface lead to two light spots 6 next to each other on the treatment surface. The distance between the light spots 6 thus indicates how large the difference is between an actual angular position at which the device is actually held and the predetermined optimal range of angular positions which has been found to result in an optimal treatment, i.e. the most efficient or satisfactory use of the device. FIGS. 2.*c* and 2.*d* are side views of the device in, respectively, FIGS. 2.*a* and 2.*b* and illustrate how the position of the light spots 6 may also move in the direction of the movement, when the angular position of the device is varied.

As described above, the light sources 5 may comprise a laser, LED, OLED, incandescent lamp or a combination thereof. Further elements, which are not shown in the figures but which will be well known to a person skilled in the art, are needed to attach these lights sources 5 to the device 1 and to electrically connect the light sources 5 with a battery or with the electricity mains via a cable. In relation to the development of the present invention, studies have been conducted using two coloured lights in the form of lasers with a 3-5 Volt input voltage attached to the epilator head of an epilator. The two or more light sources should preferably be arranged such that the light spots are provided in a region proximate to a treatment area wherein the treatment action of the operating member 3 is performed. By virtue thereof, the user needs to focus at one area only.

Figure 3:
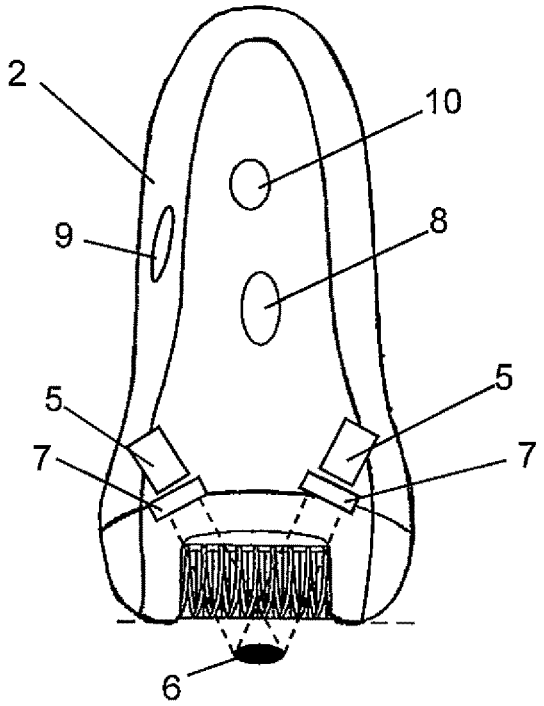
FIG. 3 schematically shows an embodiment comprising lenses in front of the light sources as well as switches.

FIG. 3 schematically shows a device as in FIG. 2, but further comprising lenses 7 arranged in front of the light sources 5 to provide a delimitation of the light spots 6. Such lenses 7 are examples of light guiding elements which will be required for light sources 5 that do not themselves provide a non-diverging beam of light. The figure shows one lens 7 in front of each light source 5, but in principle there could be more than one lens. The device in FIG. 3 further comprises a colour switch 8 which provides the user with the option of selecting between different colours of light. The illustrated device further comprises an on-off switch 9 for switching on and off the light sources 5, and a size switch 10 for changing a size and/or a shape of the light spots 6. In practice, a device 1 according to the invention may have none, one or more of these as well as other kinds of switches dependent on the type of device and the desired use possibilities. In the figure, all the switches are shown schematically with respect to shape, size and location. The figure is not intended to show how they would look on a real product. That would be decided as a part of the design process.

Figure 4:
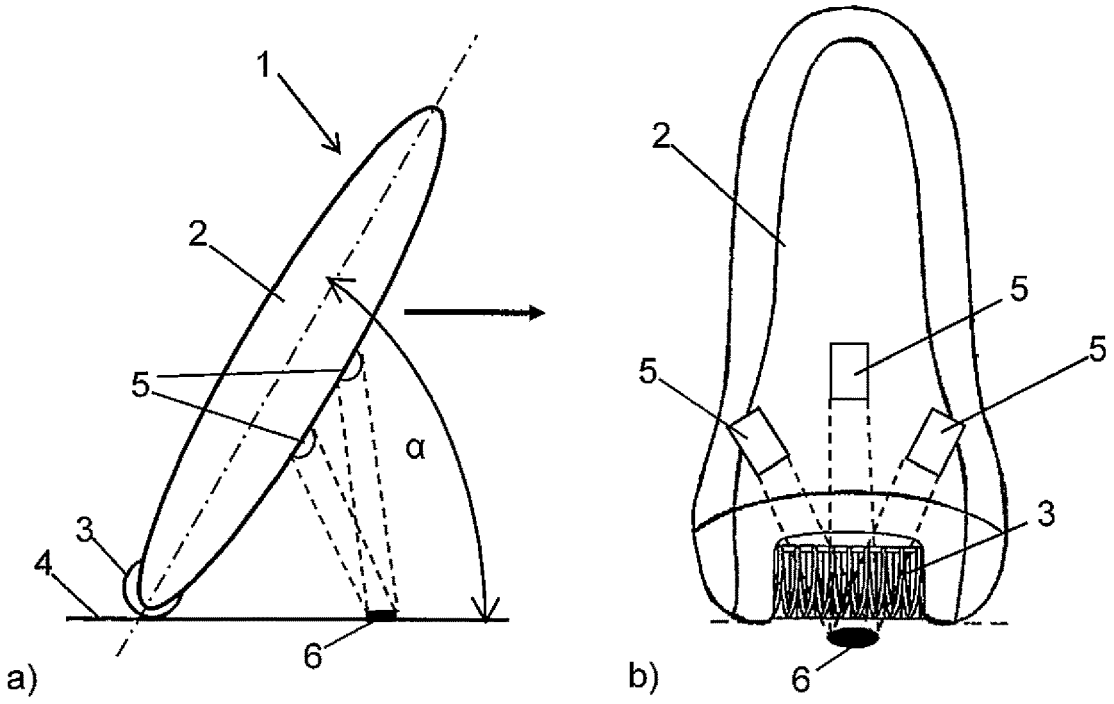
FIG. 4 schematically shows an embodiment comprising three light sources.

For some embodiments of the invention, it may be desirable to have more than two light sources 5. This is particularly relevant for devices having more degrees of freedom with respect to the movement of the device over the treatment surface. For such devices it may be advantageous to be able to obtain a more precise indication of the correspondence between an actual and an optimal angular position of the device. FIG. 4 schematically shows a device having three light sources 5. FIG. 4.*a* is a side view and FIG. 4.*b* is a front view. The embodiment of FIG. 4 with the three light sources has a similar shape as the embodiments in the previous figures for illustration only. In practice, however, the use of three or more light sources will be more relevant for other kinds of embodiments having more degrees of freedom with respect to movement, as explained above.

Figure 5:
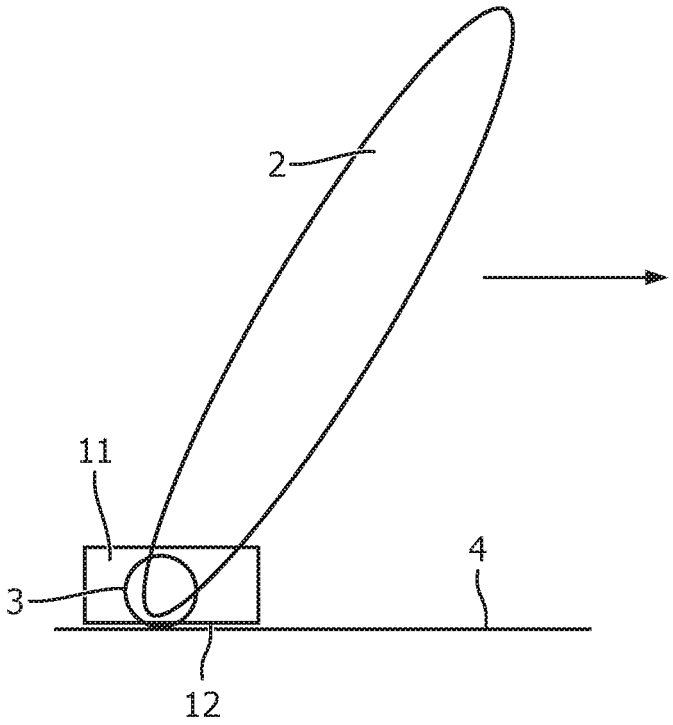
FIG. 5 schematically shows an embodiment comprising a contact member.

As shown schematically in FIG. 5, some embodiments of the invention comprise a contact member 11 arranged pivotally relative to the housing 2. The contact member 11 comprises a contact surface 12 adapted to extend parallel to the treatment surface 4 during operation of the device for facilitating a desired movement along the treatment surface 4. In this figure, the light sources and other features as shown in the previous figures are left out for clarity only. In this embodiment, an outer surface of the contact member 11, such as for example the upper surface of the contact member 11, has a predefined angular position relative to the treatment surface 4 as a result of the pivotal arrangement of the contact member 11 relative to the housing 2. In the embodiment of FIG. 5, the upper surface is always substantially parallel to the treatment surface 4. In such embodiments, instead of being provided on the treatment surface 4, the light spots may be provided on said outer surface having a predefined angular position relative to the treatment surface. In view of the predefined angular position of said outer surface relative to the treatment surface, the light spots on said outer surface will provide a similar indication to the user about the angular position of the housing 2 relative to the treatment surface 4.

Figure 6:
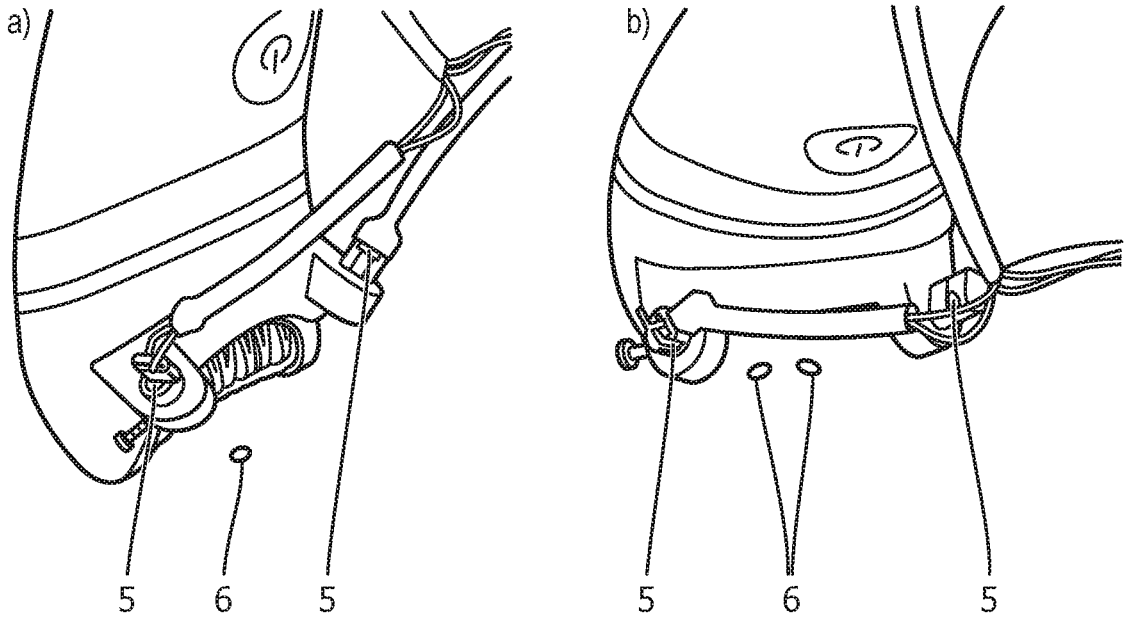
FIG. 6 shows photos of a prototype of an epilator having two light sources arranged in accordance with the invention.

As mentioned, an example of a device according to the present invention is an epilating device for epilating hair from a surface of the skin, and wherein the operating member is an epilating member. FIG. 6 shows photos of a prototype of an epilator having two light sources 5 arranged in accordance with the invention. As it is a prototype only, the light sources 5 are arranged in provisional attachments to an outer surface of the housing 2. FIG. 6.*a* shows the epilator held at a predetermined optimal angular position, resulting in coincident light spots 6, i.e. only one light spot is visible. FIG. 6.*b* shows the epilator held at a non-optimal angular position, resulting in two non-coincident light spots 6. The distance between the two light spots is an indication to the user of the difference between the actual angular position and the optimal angular position or the optimal range of angular positions. When the actual angular position is changed such that the light spots move towards each other, this will be an indication that the correct adjustment is taking place. To the contrary, if the light spots move further away from each other, this will be an indication that the actual angular position should be changed in the opposite direction.

Figure 7:
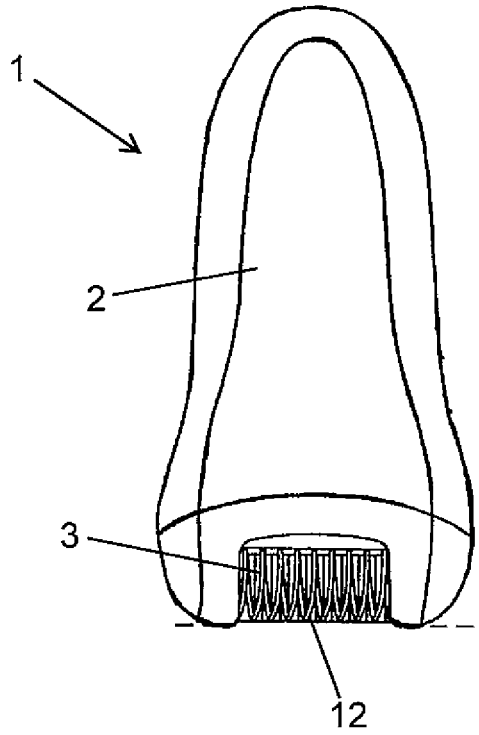
FIG. 7 shows an epilator according to the invention.

In an epilator, the epilating member 3 typically is cylindrical and comprises a plurality of disc-shaped clamping members 12 which are rotatable relative to the housing 2 about a rotational axis. An example of such an epilator is shown in a schematical front view in FIG. 7. The rotational axis is the central axis of the cylindrical epilating member 3. The predetermined optimal range of angular positions of the epilating member 3 in relation to the surface of the skin 4 is associated with an angular effective operating zone of the clamping members 12 relative to the rotational axis. The clamping members 12 typically comprise pairs of clamping elements which are adapted to open and close to clamp hairs and extract them from the skin. The angular positions of the clamping members 12 relative to the rotational axis at which the clamping members 12 open and close are predefined and determine said angular effective operating zone. This is generally known to the person skilled in the art, and details of the epilating member 3 are therefore not shown in FIG. 7. In FIG. 7, the light sources have been left out to more clearly show the clamping members.

While the invention has been illustrated and described in detail in the drawings and foregoing description, such illustration and description are to be considered illustrative or exemplary and not restrictive. The invention is not limited to the disclosed embodiments. Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. A single processor or other unit may fulfill the functions of several items recited in the claims. The mere fact that certain measures are recited in mutually different dependent claims does not indicate that a combination of these measures cannot be used to advantage. A computer program may be stored/distributed on a suitable medium, such as an optical storage medium or a solid-state medium supplied together with or as part of other hardware, but may also be distributed in other forms, such as via the Internet or other wired or wireless telecommunication systems.

Any reference signs in the claims should not be construed as limiting the scope.

The invention claimed is:

1. Handheld device adapted to be moved along a plane of a treatment surface while being held at an angular position (α) relative to the treatment surface, the device comprising:

a housing, and an operating member arranged at least partially within the housing, the operating member being adapted to perform a treatment action on or close to the treatment surface when the device is in operation, wherein a result of the treatment action is dependent on the angular position (α) relative to the treatment surface, and wherein the device further comprises two or more light sources wherein the two or more light sources are arranged and adapted to each provide, during operation of the device, a delimited light spot on the plane of the treatment surface or on an outer surface of the device, said outer surface having a predefined angular position relative to the treatment surface when the device is in operation, and wherein the two or more light sources are arranged so that the light spots provided by the two or more light sources are:

at least partially coincident when the device is held at an angular position relative to the treatment surface which is within a predetermined optimal range of angular positions for which the treatment action of the operating member is optimal, and non-coincident when the device is held at an angular position relative to the treatment surface which is outside said predetermined optimal range of angular positions, and wherein the device is an epilating device for epilating hair from a surface of a skin, and wherein the operating member is an epilating member.

2. Device according to claim 1, wherein the two or more light sources comprise a laser, LED, OLED, incandescent lamp or a combination thereof.

3. Device according to claim 1, further comprising one or more light guiding components, such as lenses or light guides, arranged in relation to the two or more light sources to provide a delimitation of the light spots.

4. Device according to claim 1, wherein the two or more light sources are arranged such that the light spots are provided in a region proximate to a treatment area wherein the treatment action of the operating member is performed.

5. Device according to claim 1, wherein different colours of light of the light sources are selectable.

6. Device according to claim 1, further comprising at least one on-off switch for switching on and off the two or more light sources.

7. Device according to claim 1, further comprising at least one size switch for changing a size of the light spots.

8. Device according to claim 1, comprising three or more light sources.

9. Device according to claim 1, further comprising a contact member arranged pivotally relative to the housing, said contact member comprising a contact surface adapted to extend parallel to the treatment surface during operation of the device for facilitating a desired movement of the device along the treatment surface.

10. Device according to claim 1, wherein the epilating member comprises clamping members which are rotatable relative to the housing about a rotational axis, and wherein the predetermined optimal range of angular positions is associated with an angular effective operating zone of the clamping members relative to the rotational axis.

11. Device according to claim 10, wherein the clamping members comprise pairs of clamping elements which are adapted to open and close to clamp hairs and extract the hairs from the skin during rotation of the clamping members about the rotational axis, and wherein the angular positions of the clamping members relative to the rotational axis, in which the clamping members open and close, are predefined.

* * * * *